United States Patent [19]

Weronke et al.

[11] 4,289,488

[45] Sep. 15, 1981

[54] STERN DRIVE GIMBAL ARRANGEMENT

[75] Inventors: Robert B. Weronke, Oshkosh; Herbert A. Bankstahl, Fond du Lac, both of Wis.

[73] Assignee: Brunswick Corporation, Skokie, Ill.

[21] Appl. No.: 13,039

[22] Filed: Feb. 21, 1979

[51] Int. Cl.[3] ..... B63H 25/42

[52] U.S. Cl. ..... 440/57; 403/236; 403/373; 440/63

[58] Field of Search ..... 115/35, 41 R; 403/234, 403/235, 236, 261, 373, 383; 440/57, 63

[56] References Cited

U.S. PATENT DOCUMENTS

| | | | |
|---|---|---|---|
| 564,208 | 7/1896 | Meeker | 403/236 |
| 570,613 | 11/1896 | Smith | 115/35 X |
| 598,237 | 2/1898 | Beebe | 403/234 |
| 1,294,792 | 2/1919 | Gray | 403/261 |
| 1,911,459 | 5/1933 | Mitchell | 403/234 |
| 3,136,285 | 6/1964 | Kiekhaefer | 115/35 |
| 3,136,287 | 6/1964 | North | 115/35 X |
| 3,339,517 | 9/1967 | Bergstedt | 115/35 X |
| 4,119,053 | 10/1978 | Yoshitomi et al. | 115/35 |

FOREIGN PATENT DOCUMENTS

| | | | |
|---|---|---|---|
| 2314727 | 10/1974 | Fed. Rep. of Germany | 403/373 |
| 498629 | 4/1919 | France | 403/234 |

OTHER PUBLICATIONS

Mercury Marine Drawing No. E-53-51092, Layout Steering Levers, May 9, 1975.

*Primary Examiner*—Charles E. Frankfort
*Attorney, Agent, or Firm*—O. Thomas Sessions

[57] ABSTRACT

In a stern drive for watercraft, of the type using a gimbal ring to support the external propulsion unit, the gimbal ring is provided with an upper vertical square bore, a slot across the bore, and clamping bolts to provide full engagement with the square sides of a steering swivel shaft.

1 Claim, 6 Drawing Figures

STERN DRIVE GIMBAL ARRANGEMENT

BACKGROUND OF THE INVENTION

This invention relates to a stern drive for watercraft and particularly to a gimbal ring steering arrangement for use with a stern drive.

Kiekhaefer, in U.S. Pat. No. 3,136,285, describes a steering arrangement having a gimbal ring with a generally vertical steering swivel shaft rotatably disposed in a transom bracket attached to the transom of a watercraft. The drive unit is pivotally supported by the gimbal ring on a generally transverse horizontal axis to provide tilt movement. In this arrangement the steering swivel shaft is attached to the gimbal ring by a splined connection. Such an arrangement has proven highly satisfactory because it permits a steering arm to be attached to the steering swivel shaft and extend forwardly through the transom mounting opening and into the interior of the watercraft, thereby providing a compact arrangement which allows the steering control means to attach to the steering arm inside the boat. This prior art device fails to achieve full contact between the mating surfaces of the steering swivel shaft and the gimbal ring.

One other prior art device utilized a square bore in the gimbal ring and a complementary steering swivel shaft section to replace the splined joint disclosed by Kiekhaefer. The swivel shaft of this device was split along its axis through the square section and used a screw on the shaft axis to spread the shaft and force it into contact with the gimbal ring. This device failed to achieve contact along the full vertical length of the mating surfaces.

SUMMARY OF THE INVENTION

The inventors have found that in a gimbal ring steering arrangement of the aforementioned type substantially full contact along the full length of the engaging portions of the gimbal ring and the steering swivel shaft can be achieved by:

(1) using a vertical gimbal ring bore having a cross-section with four or less sides;

(2) using a steering swivel shaft having a lower cross-section complementary to the cross-section of the vertical gimbal ring bore; and (3) providing the gimbal ring with a means to clamp the sides of the vertical gimbal ring bore against the complementary sides of the steering swivel shaft.

DESCRIPTION OF THE PREFERRED EMBODIMENT

Figure 1:
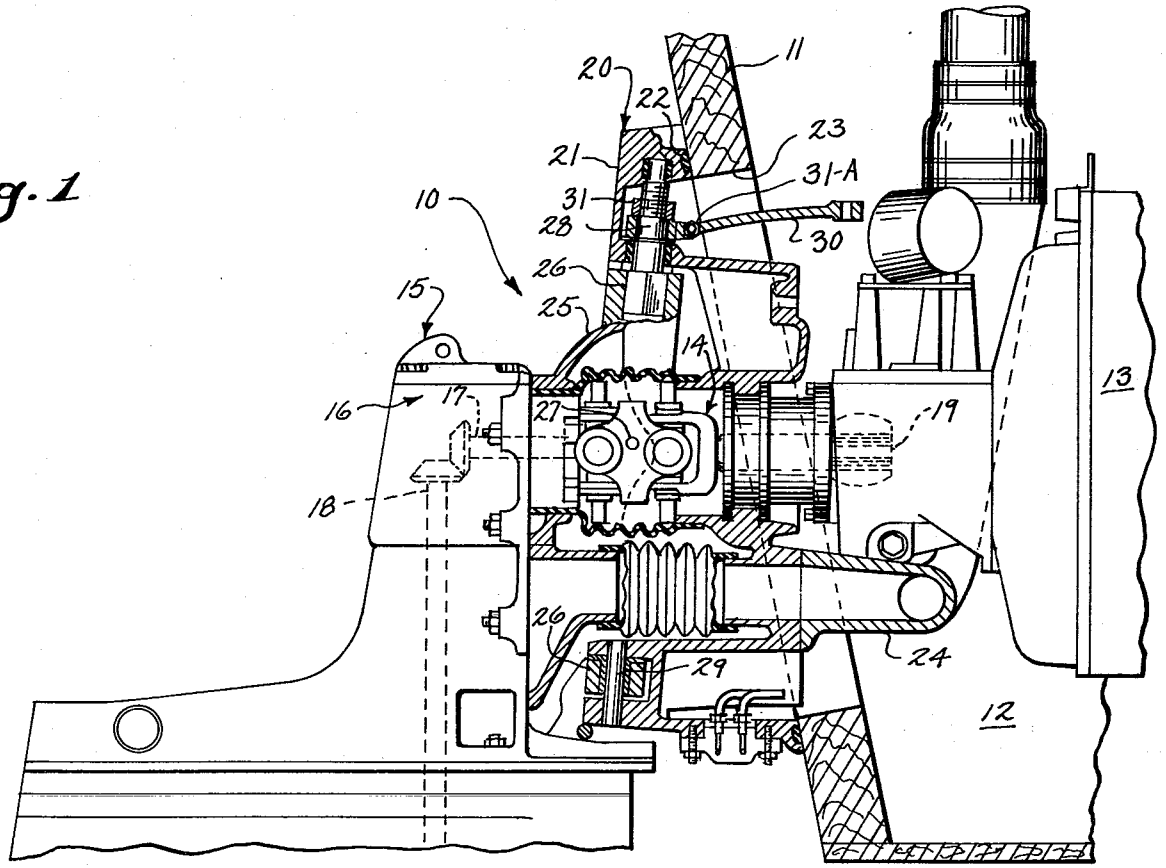
FIG. 1 is a side elevational view partially in section of a stern drive unit attached to the transom of a boat, particularly illustrating the gimbal ring and steering arm assembly.

FIG. 1 illustrates a stern drive 15 and gimbal housing assembly 20 mounted to the transom 11 of a boat 12. An internally mounted engine 13 is secured within the boat 12 and connected through a universal joint 14 to the stern drive 15. The stern drive 15 generally includes a drive shaft housing 16 having a horizontal drive shaft 17 and a vertical drive shaft 18. The horizontal drive shaft 17 is connected by a universal joint 14 to a shaft 19 which in turn is connected to the crankshaft of the engine 13.

The gimbal housing assembly 20 secures the stern drive 15 to the transom 11. The gimbal housing assembly 20 generally includes a gimbal housing 21 and a transom seal 22 for sealing the transom opening 23. The gimbal housing assembly 20 also includes openings through which the shaft 19 and engine exhaust tube 24 extend. The gimbal housing assembly 20 further includes a bell housing 25 pivotally attached by horizontal pivots 27 to the gimbal ring 26. The gimbal ring 26 is in turn attached to the gimbal housing 21 by upper and lower swivel shafts 28 and 29. The bell housing 25 is bolted to the drive shaft housing 16.

A steering lever 30 is attached to the upper swivel shaft 28 to provide steering control of the stern drive 15. The steering lever 30 is held in place by a retaining screw and nut 31A and nut 31. In practice, the internal end of the steering lever 30 may be controlled by any conventional boat steering system such as a steering wheel and cable system.

Figure 4:
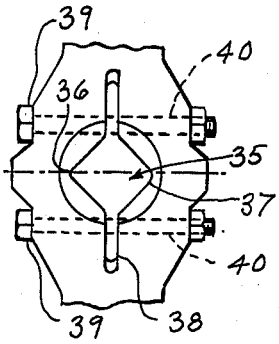
FIG. 4 is a partial top view of the gimbal ring.
Figure 2:
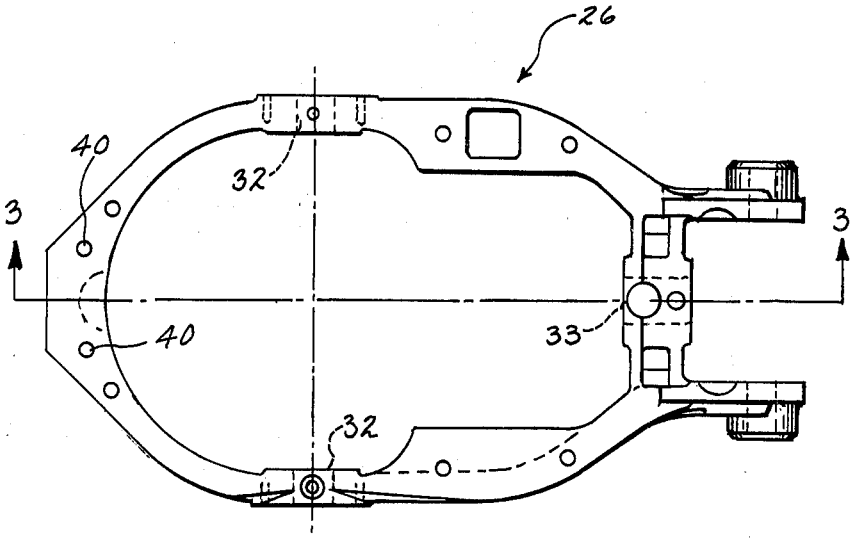
FIG. 2 is a rear view of the gimbal ring.
Figure 3:
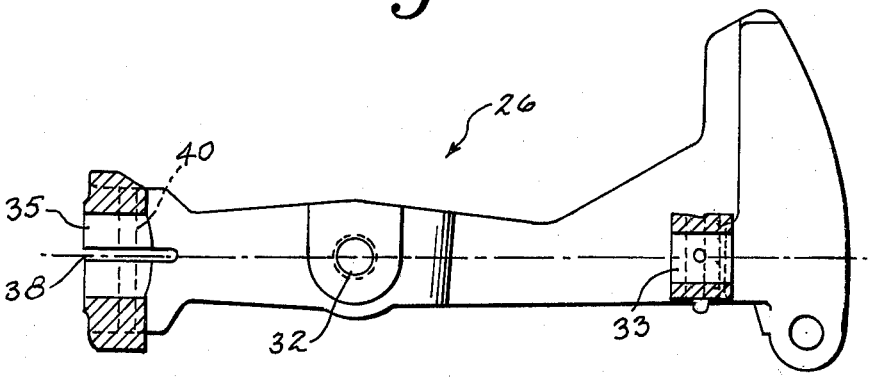
FIG. 3 is a sectional view of the gimbal ring.

FIGS. 2, 3, and 4 are views showing details of the preferred embodiment of the gimbal ring 26. The gimbal ring 26 is made of cast aluminum and has horizontal bores 32 to provide a pivotal attachment to the bell housing 25. The upper gimbal ring bore 35 is square in cross-section and is formed by a broaching operation. The forward and aft corners 36 and 37 of the bore 35 are rounded to provide stress relief and the bore walls are provided with a substantial thickness for added strength both fore and aft.

A slot 38 is provided transversely across the top of the gimbal ring 26, running across the side corners of the square bore 35. The slot 38 is formed deeper than the bore 35 so that the sides of the bore 35 will remain substantially parallel when clamped against the sides of the upper gimbal ring shaft 28 by means of the bolts 39, which run through holes 40 in the gimbal ring 26.

Figure 6:
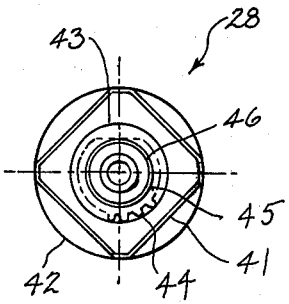
FIG. 6 is an end view of the shaft of FIG. 5.
Figure 5:
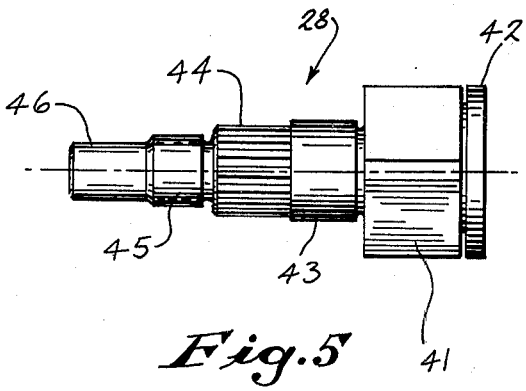
FIG. 5 is a side elevational view of the upper swivel shaft.

FIGS. 5 and 6 are enlarged views of the preferred embodiment of the upper swivel shaft 28. The shaft has a square cross-section 41 for engagement with the square bore 35 of the gimbal ring 26. The shaft 28 also includes a circular cap 42 at the lower end for correctly locating the bearing surfaces 43 and 46 in the gimbal housing assembly 20. In addition, male splines on section 44 engage with female splines on the steering lever 30, and the shaft 28 is axially positioned by a nut 31 engaging with the threaded section 45.

The upper gimbal ring bore 35 and the square section 41 of the steering swivel shaft 28 are designed to have a minimal clearance for initial assembly, but to produce substantially full engagement of the corresponding flat surfaces when clamping pressure is applied by bolts 39. The effect of tightening bolts 39 is to produce a clamping action between the fore and aft sides of the bore 35. Full contact between the engaging sufaces is assured by placing the bolt holes 40 near the lower end of the bore 35, as most clearly seen in FIG. 3. This accommodates for the bending in the fore and aft sides of the slot 38 as the bolts 39 are tightened.

Though the preferred embodiment of the invention has a square upper bore 35 in the gimbal ring 26 and a corresponding square section 41 in the upper swivel shaft 28, it is recognized that other cross-sections, such as triangular or rectangular, could be used. Whatever section is used, it must be readily clamped by a small number of bolts to produce substantially full engagement between the mating surfaces, thereby securely retaining the upper swivel shaft in the gimbal ring.

We claim:

1. A drive assembly for mounting on the transom of a watercraft, including (A) a stern drive mounted externally of the watercraft;

(B) a gimbal housing attached to the watercraft;

(C) a gimbal ring member for pivotally attaching the stern drive to the gimbal housing for trim and steering control;

(D) a generally vertical steering swivel shaft pivotally attaching the gimbal ring member to the gimbal housing; and (E) a steering lever attached to the upper portion of the steering swivel shaft to provide steering control of the drive unit;

wherein the improvement comprises:

(1) the gimbal ring member having a generally vertical bore with a generally square cross-section;

(2) the steering swivel shaft having a lower cross-section complementary to the cross-section of the vertical gimbal ring bore; and (3) clamping means to clamp the sides of the vertical gimbal ring bore against the complementary sides of the swivel shaft to produce substantially full engagement between the sides of said bore and the complementary sides of said swivel shaft along the full length of the bore, said clamping means comprising:

(a) a slot in the gimbal ring extending diagonally through the cross-section of the gimbal ring bore, the slot lying in a plane including the axis of the gimbal ring bore and extending into the gimbal ring on both sides of the gimbal ring bore; and (b) a bolt through the gimbal ring member on each side of the gimbal ring bore to force the sides of the slot together, with said bolts positioned offset toward the bottom of said gimbal ring bore to compensate for the bending of the gimbal ring as said bolts are tightened.

* * * * *